United States Patent [19]

Sakamoto et al.

[11] Patent Number: 4,659,158

[45] Date of Patent: Apr. 21, 1987

[54] ELECTRIC CONNECTOR WITH CONTACT HOLDING MECHANISM

[75] Inventors: Haruo Sakamoto; Motomu Kajiura, both of Tokyo, Japan

[73] Assignee: E. I. Du Pont de Nemours and Company, Wilmington, Del.

[21] Appl. No.: 810,363

[22] Filed: Dec. 18, 1985

[30] Foreign Application Priority Data

Dec. 28, 1984 [JP] Japan ..... 59-202148

[51] Int. Cl.[4] ..... H01R 13/422

[52] U.S. Cl. ..... 339/19; 339/59 M

[58] Field of Search ..... 339/59 M, 59 R, 19

[56] References Cited

U.S. PATENT DOCUMENTS 3,944,312 3/1976 Koenig ..... 339/59 R
4,214,801 7/1980 Cairns et al. ..... 339/59 R
4,253,718 3/1981 Bungo ..... 339/59 R
4,295,698 10/1981 Chow ..... 339/59 R
4,474,417 10/1984 Millhimes et al. ..... 339/59 M

FOREIGN PATENT DOCUMENTS 40757 10/1973 Australia ..... 339/59 R

*Primary Examiner*—Daniel C. Crane

[57] ABSTRACT

An electric connector comprises a female contact and a thermoplastic housing. The contact has upper and lower click pieces. The housing has a contact receiving hollow open on its rear side. A pair of slits, spaced apart from each other, are cut in the top of the housing. One end of each slit reaches an opening of the hollow. A projection for retaining the upper click piece is formed on the lower surface of that portion of the top which is defined by the two slits. A step for retaining the lower click piece is cut in the inner surface of the bottom of the housing and faces the projection.

8 Claims, 4 Drawing Figures

ELECTRIC CONNECTOR WITH CONTACT HOLDING MECHANISM

BACKGROUND OF THE INVENTION

The present invention relates to an electric connector, and, more specifically, to a miniature, female electric connector provided with a contact holding mechanism by which the female contact can be held in a connector housing.

Generally, it is necessary that the female contact of a connector of this type be prevented from slipping out of a connector housing when it is mated with a male connector. For this reason, conventional connectors are constructed such that the contact is formed with, for example, a claw or click piece, while an engaging portion with which to engage the click piece is formed in the housing so that the contact can be engagedly held in the housing.

With respect to the prior art connectors, when a male pin is force-fitted into a pin receiving portion of the contact, the contact is prevented from coming out of the housing. It is, however, extremely difficult to prevent the contact from skewing in the housing. Thus, conventional connectors are subject to such drawbacks as contact deformation, contact fault between pin and contact, etc.

As means of eliminating these drawbacks, a pair of click pieces, extending in different directions, may, for example, be formed on the contact so that one of the two click pieces engages with a portion of the ceiling of the housing and the other engages with a portion of the floor of the housing. Provision of a pair of click pieces, however, makes it much more difficult to insert the connector into the housing at the time of assembly than in the case where the contact has a single click piece.

SUMMARY OF THE INVENTION

According to the invention, there is provided an electric connector comprising a thermoplastic housing and a contact having at least one pin receiving portion. The contact has two click pieces set apart from each other. The housing has a rear wall, a top and a bottom, which define at least one hollow accommodating the contact. The rear wall has an opening through which the contact can be inserted into the hollow. Two slits are cut in the top, forming three members. A first retaining member is formed on the inner surface of the middle member, and a second retaining member is formed on the inner surface of the bottom. The first and second retaining members hold the first and second click pieces of the contact when a pin is inserted in the pin receiving portion of the contact.

DETAILED DESCRIPTION OF THE PREFERRED EMBODIMENTS

Figure 1:
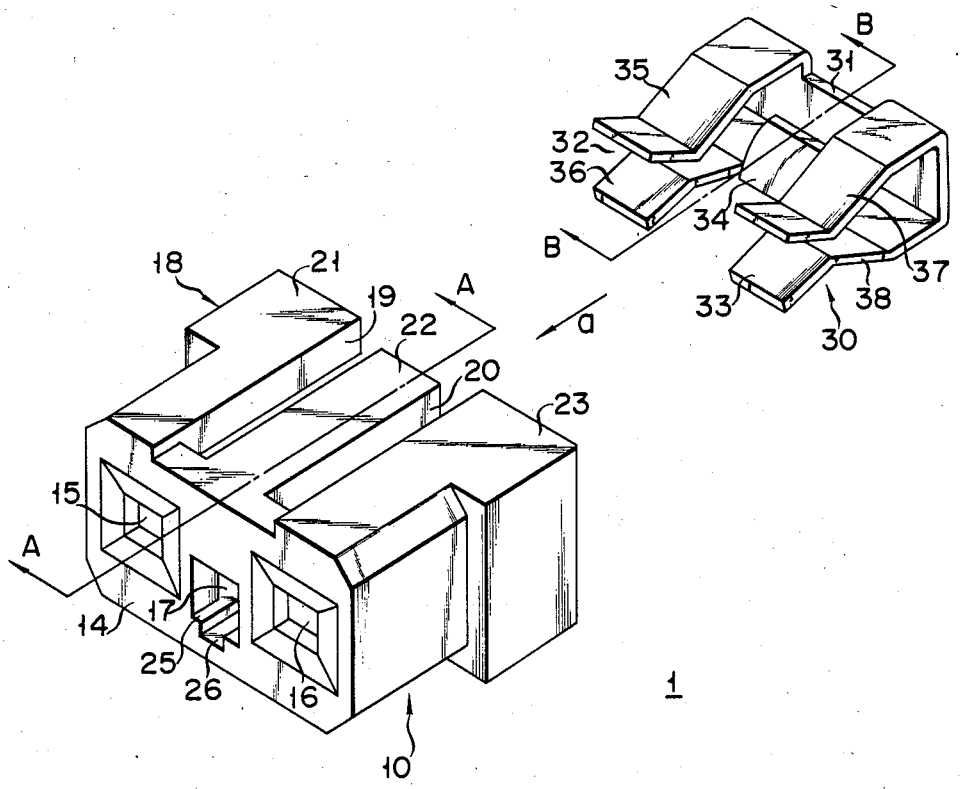
FIG. 1 is an exploded perspective view of a shunt connector according to an embodiment of the present invention.
Figure 2:
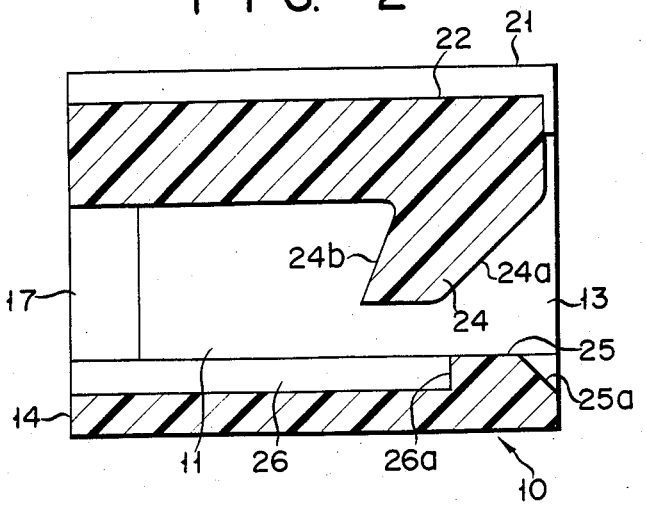
FIG. 2 is an enlarged sectional view of a housing, taken along line A—A of FIG. 1.
Figure 3:
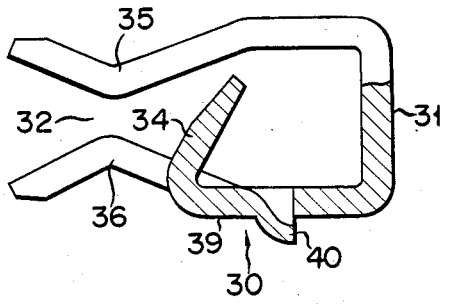
FIG. 3 is an enlarged sectional view of a contact, taken along line, B—B of FIG. 1.

An embodiment of the present invention, applied to a miniature shunt connector, will now be described in detail with reference to the accompanying drawings of FIGS. 1 to 4.

Shunt connector 1 comprises housing 10 and contact 30. Housing 10 is formed from a thermoplastic resin with a high insulating capability such as nylon 66 by injection molding using dies. Housing 10 is formed with hollow 11, in which female contact 30 is to be mounted. The rear face of housing 10 is open and constitutes opening 13 through which contact 30 is fitted into hollow 11. Square passage holes 15 and 16 for male pins are formed at bilateral positions in front wall 14 of housing 10, and communicate with hollow 11. The edges of holes 15 and 16 are tapered to allow the male pins to be inserted correctly and easily. A substantially square hole 17 is formed in a lower central portion of front wall 14 of housing 10, and communicates with hollow 11. Hole 17 facilitates the removal of the dies from housing 10 after housing 10 has been molded.

Top 18 of housing 10 has two slits 19 and 20. These slits extend at substantially right angles to the plane in which opening 13 is located. They divide top 18 into three portions 21, 22 and 23. Of these portions, central portion 22 is elastic and has a movable end at opening 13. The top of portion 22 is lower than those of portions 21 and 23. Projection 24 protrudes downward from the movable end of portion 22 and is positioned within hollow 11. Rear face 24*a* of projection 24 is tapered downward from the plane in which opening 13 is located.

Groove 26 is cut in the inner surface of bottom 21 of housing 10. This groove extends parallel to slits 19 and 20. Its one end reaches hole 17. Step 26*a* is formed in the inner surface of bottom 21 at the other end of groove 26, and is located in front of front face 24*b* of projection 24. That portion of periphery of opening 13 which is located on the axis of groove 26 has a slanting surface 25*a*. More specifically, surface 25*a* is tapered upward from the plane in which opening 13 is located. Slanting surface 25*a* facilitates the insertion of lower click piece 40 (FIG. 3) of contact 30 into hollow 11.

Female contact 30 is formed of a plate of metal with high conductivity and elasticity, such as phosphor bronze. As shown in FIG. 1, contact 30 has a base portion 31, pin receiving portions 32 and 33 formed integrally with base portion 31, and an upper click piece 34. Pin receiving portion 32 includes contact pieces 35 and 36 which extend from the upper and lower edges, respectively, of base portion 31 at one end thereof, substantially at right angles thereto. Pin receiving portion 33 includes contact pieces 37 and 38 which extend from the upper and lower edges, respectively, of base portion 31 at the other end thereof, in the same direction as contact pieces 35 and 36. Contact pieces 35 and 36 are slightly bent inward at their rear intermediate portion and outward at their front intermediate portion, thus forming pin receiving portion 32 with high elasticity. Likewise, contact pieces 37 and 38 are slightly bent inward at their rear intermediate portion and outward at their front intermediate portion, thus forming highly elastic pin receiving portion 32. Upper click piece 34 is formed by upwardly bending the forward end of a support piece 39 which extends in the same direction as contact pieces 35 to 38 from the lower edge of the central portion of base portion 31. As shown in the sectional view of FIG. 3, part of support piece 39 is turned up opposite to upper click piece 34, forming lower click piece 40.

The vertical and horizontal positions of pin receiving portions 32 and 33 are adjusted so as to correspond to those of holes 15 and 16 when contact 30 is set in hollow 11 of housing 10. Also, upper and lower click pieces 34 and 40 are positioned so as to correspond to front face 24*b* of projection 24 and step 26*a* of groove 26, respectively, when contact 30 is set in hollow 11 of housing 10.

Housing 10, contact 30 and other components constituting miniature shunt connector 1 roughly measure as follows. Housing 10 is about 2.5 mm high, 5.0 mm wide, and 3.5 mm deep. Contact 30 is about 1.4 mm high, 4.0 mm wide, and 2.7 mm deep. Upper and lower click pieces 34 and 40 measure about 0.9 mm and 0.3 mm in height, respectively.

To assemble connector 1, contact 30 is inserted into hollow 11 through opening 13 as indicated by arrow a (FIG. 1). As a result, the front end of contact 30 is positioned in the front part of hollow 11, and the tip of upper click piece 34 pushes rear face 24*a* of projection 24. Portion 22 is therefore bent upward as the tip of upper click piece 34 slides along rear face 24*a* and pushes rear face 24*a*. Thus, contact 30 is inserted smoothly into hollow 11. Meanwhile, lower click piece 40 of contact 30 is guided on slanting surface 25*a* into hollow 11. In consequence, contact 30 can more smoothly be inserted into hollow 11.

Were portion 22 not elastic, it would be difficult to insert contact 30 into hollow 11 unless the tip portion of upper click piece 34 is elastically deformed downward. (Since upper click piece 34 is only about 0.9 mm tall in miniature connector 1, it can hardly be deformed.)

Figure 4:
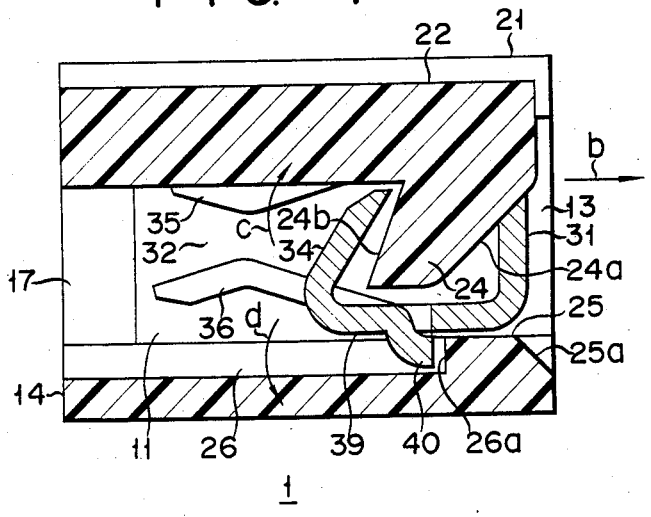
FIG. 4 is a sectional view, corresponding to FIG. 2, showing the connector fitted with the contact.

When the tip of upper click piece 34 starts to slide along the undersurface of projection 24 after sliding along rear face 24*a*, portion 22 bends to a maximum degree. When the tip of upper click piece 34 goes behind projection 24, portion 22 is restored to its original state by its resiliency. Thereupon, upper click piece 34 opposes front face 24*b* of projection 24, as shown in FIG. 4. On the other hand, lower click piece 40 of contact 30 slips into groove 26 and faces step 26*a* of groove 26. Then, contact 30 is pushed into hollow 11 of housing 10 until the front ends of pin receiving portions 32 and 33 abut against the inner surface of front wall 14. At this time, the connector 1 is assembled. Connector 1 is designed so that the gaps of about 0.2 mm are provided between upper click piece 34 and front face 24*b* of projection 24 and between lower click piece 40 and step 26*a* of groove 26.

In assembling connector 1, portion 22 may not be able to return completely to its original state. If the top of portion 22 is flush with those of portions 21 and 23, portion 22 will project above portions 21 and 23 to increase the external dimensions of housing 10, making it difficult to mount connector 1 on a printed board or the like. Since the top of portion 22 is lower than those of portions 21 and 23, portion 22 will never project above portions 21 and 23 even if it leaves any flexure thereon.

Assembled in this manner, shunt connector 1 can short-circuit between any adjacent pair of pins (not shown). The two adjacent pins are force-fitted into pin receiving portions 32 and 33 of contact 30 through square holes 15 and 16 of housing 10. When the pins are received by pin receiving portions 32 and 33, contact 30 moves back to opening 13. At the same time, upper click piece 34 of contact 30 engages front face 24*b* of projection 24, thus preventing contact 30 from slipping out of housing 10 in the direction indicated by arrow b in FIG. 4. Also, contact pieces 35 to 38, in particular, of contact 30 are prevented from skewing in the direction indicated by arrow c in FIG. 4. On the other hand, lower click piece 40 of contact 30 engages step 26*a* of groove 26 to securely prevent contact 30 from coming off in the direction of arrow b, and contact pieces 35 to 38 from skewing in the direction indicated by arrow d in FIG. 4.

Although an illustrative embodiment of the present invention has been described in detail herein, it is to be understood that the invention is not limited to the precise embodiment, and that various changes and modifications may be effected therein by one skilled in the art without departing from the scope or spirit of the invention. For example, groove 26 can be replaced with a projection. In this case, the rear face of the projection should preferably be tapered. Also, the invention can be applied to a conventional electric connector which has a plurality of hollows therein, and in which contacts each having a single pin receiving portion are set independently in the hollows.

What is claimed is:

1. An electrical connector comprising:

a contact including at least one pin receiving portion;

a first click piece formed on the contact;

a second click piece formed on the contact and set apart from the first click piece;

a thermoplastic housing having at least one hollow in which the contact is set, said hollow being defined by a top plate, a bottom plate opposed to the top plate at a distance therefrom, and an opening cut in the rear side of the housing, through which the contact is inserted into the hollow, said top plate having a pair of slits spaced and opposted to each other, one end of each said slit extending to and terminating at the rear side of the housing where the opening is cut in said rear side so that said slits open into the rear side of the housing;

a first retaining portion formed on that portion of the inner surface of the top plate between said one end of the two slits and in the vicinity of the opening, whereby the second click piece is held in position when a pin is inserted in the pin receiving portion of the contact placed within the hollow; and a second retaining portion formed on the inner surface of the bottom plate so as to face the first retaining portion, whereby the second click piece is held in position when the pin is inserted in the pin receiving portion of the contact placed within the hollow.

2. The connector according to claim 1, wherein said first retaining portion projects toward the bottom plate.

3. The connector according to claim 2, wherein the rear face of said first retaining portion is tapered from the opening toward the bottom plate.

4. The connector according to claim 1, wherein said second retaining portion is formed of a step of a groove formed in the bottom plate.

5. The connector according to claim 1, wherein that portion of the outer surface of the top plate between the two slits is recessed.

6. The connector according to claim 1, wherein said contact further includes another pin receiving portion paired with the pin receiving portion and a base portion for the two pin receiving portions, one of said two pin receiving portions extending from one end portion of the base portion and the other from the other end portion of the base portion, substantially at right angles to the base portion.

7. The connector according to claim 6, wherein said contact further includes a support piece extending in the same direction as the two pin receiving portions from the central portion of the base portion, said support piece having the first click piece on the front end thereof.

8. The connector according to claim 7, wherein said second click piece is formed by turning up part of the support piece.

* * * * *